US007708633B2

(12) United States Patent
Lind et al.

(10) Patent No.: US 7,708,633 B2
(45) Date of Patent: May 4, 2010

(54) APPARATUS AND METHOD FOR MAPPING MULTIPLE BINGO GAME RESULTS TO A COMMON DISPLAY

(75) Inventors: Clifton E. Lind, Austin, TX (US); Jefferson C. Lind, Austin, TX (US)

(73) Assignee: Multimedia Games, Inc., Austin, TX (US)

( * ) Notice: Subject to any disclaimer, the term of this patent is extended or adjusted under 35 U.S.C. 154(b) by 1499 days.

(21) Appl. No.: 11/044,406

(22) Filed: Jan. 27, 2005

(65) Prior Publication Data

US 2005/0130730 A1 Jun. 16, 2005

Related U.S. Application Data

(63) Continuation-in-part of application No. 10/456,721, filed on Jun. 6, 2003.

(60) Provisional application No. 60/444,503, filed on Feb. 3, 2003.

(51) Int. Cl.
*A63F 9/24* (2006.01)

(52) U.S. Cl. ..... 463/19; 463/20; 463/30

(58) Field of Classification Search ..... 463/19, 463/16, 17, 18, 20, 21, 30, 31; 273/269, 273/270

See application file for complete search history.

(56) References Cited

U.S. PATENT DOCUMENTS 5,393,057 A * 2/1995 Marnell, II ..... 463/13
5,857,911 A 1/1999 Fioretti
5,935,002 A 8/1999 Falciglia
6,012,984 A 1/2000 Roseman
6,159,095 A * 12/2000 Frohm et al. ..... 463/19
6,186,892 B1 2/2001 Frank et al.
6,203,433 B1 3/2001 Kume
6,280,325 B1 8/2001 Fisk
6,398,645 B1 * 6/2002 Yoseloff ..... 463/19
6,428,413 B1 8/2002 Carlson
6,537,150 B1 * 3/2003 Luciano et al. ..... 463/16
6,569,017 B2 5/2003 Enzminger et al.
6,581,935 B1 6/2003 Odom
6,585,590 B2 7/2003 Malone
6,656,040 B1 12/2003 Brosnan et al.
6,729,959 B1 5/2004 Moore et al.
6,743,102 B1 6/2004 Fiechter et al.
6,780,108 B1 8/2004 Luciano et al.
2001/0031660 A1 10/2001 Wilk et al.
2002/0094859 A1 7/2002 Hirsch et al.
2002/0094860 A1 7/2002 Itkis et al.

(Continued)

OTHER PUBLICATIONS

"EverGreen and Tooty Frooty Bingo. Same Game, Two Names." Brochure, 1 page (front and back), Dec. 1998.

*Primary Examiner*—James S McClellan
(74) *Attorney, Agent, or Firm*—Russell C. Scott; Nathan H. Calvert; J P Cody

(57) ABSTRACT

A bingo game player may participate in a number of bingo games and obtain results for each of those games. These bingo game results are combined to amount to a cumulative result and a common graphic display is produced that is representative of the cumulative result. The common graphic display is then shown to the player on the display device of a particular electronic player station.

20 Claims, 5 Drawing Sheets

U.S. PATENT DOCUMENTS

2002/0132661 A1 9/2002 Lind et al.
2002/0132666 A1 9/2002 Lind et al.
2002/0177478 A1* 11/2002 Glasson et al. ..... 463/19
2003/0064772 A1* 4/2003 Tempest et al. ..... 463/16
2004/0009811 A1 1/2004 Torango
2004/0048647 A1 3/2004 Lind et al.
2004/0152510 A1 8/2004 Herrmann et al.

* cited by examiner

APPARATUS AND METHOD FOR MAPPING MULTIPLE BINGO GAME RESULTS TO A COMMON DISPLAY

CROSS-REFERENCE TO RELATED APPLICATIONS

This application is a continuation-in-part of the U.S. non-provisional patent application Ser. No. 10/456,721 filed Jun. 6, 2003, and entitled "Method, System, and Program Product for Conducting Multiple Concurrent Bingo-Type Games," which claims the benefit of U.S. provisional patent application No. 60/444,503 filed Feb. 3, 2003 and entitled "Rapid Play Electronic Bingo Gaming System." The Applicants claim the benefit of the above non-provisional patent application under 35 U.S.C. §120, and claim the benefit of the provisional application under 35 U.S.C. §119(e). The entire content of each of these applications is incorporated herein by this reference.

TECHNICAL FIELD OF THE INVENTION

This invention relates to electronic gaming systems that enable players to rapidly participate in multiple bingo games. More particularly, the invention is directed to apparatus and methods that enhance a player's bingo game play experience and increase overall player participation in bingo games by rapidly displaying the results of multiple bingo games to a player.

BACKGROUND OF THE INVENTION

The game referred to generally as "bingo" is played with predetermined bingo cards having designations, such as numbers, letters, or other symbols, randomly arranged in a grid or other layout on a bingo card. The locations of such designations on a bingo card are sometimes referred to as spots or locations. Bingo cards may be physically printed on paper or another suitable material, or may be represented by a data structure that defines the various locations and the designations associated with the locations. In a traditional bingo game sequence, a number of predetermined bingo cards are put in play for a particular game. After the sale of bingo cards is closed for a given game, designations are randomly selected from a pool of available designations, such as by drawing marked balls from a tumbler. The selected designations are then matched to the designations on each bingo card that is in play for the game. This matching, which is commonly referred to as daubing the bingo card, results in an individual pattern of matched spots for each card. In traditional bingo games daubing was done manually by the player holding a bingo card. If the player's daubing indicated the bingo card had a game ending pattern, the player would announce the win or "bingo" and the card was again daubed by a game administrator in order to verify the game ending pattern. More recent bingo game systems automatically check for game ending patterns on a bingo card as designations are randomly selected for a game. This automated daubing may be in lieu of or in addition to daubing by the player. Regardless of how the bingo cards in play for a game are daubed, the first bingo card that is daubed in some predefined way is considered a winning bingo card for the game.

Although traditional paper bingo games remain popular, the speed with which such traditional games are played is often an issue among today's players, who are increasingly accustomed to more fast-paced entertainment. That is, certain steps in the traditional paper bingo game are relatively time consuming. These include time allotted for bingo card purchasing (the buy-in period), followed by a period for drawing a sequence of balls, for which there is an announcement of each individual designation that is drawn, followed by a period to allow players to manually daub their bingo card or cards, and then a time for winner verification. The time required to play a traditional bingo game tends to limit player excitement and satisfaction.

Various systems have been developed to aid players in playing bingo games and to enhance player participation in the games. Some bingo gaming systems allow players to participate in bingo games through electronic player stations, and may dispense with the cumbersome distribution of paper bingo cards. Some bingo gaming systems allow players at different gaming facilities, which may be spaced apart over a large geographic area, to participate in bingo games through electronic player stations maintained at the various gaming facilities. These bingo gaming systems may greatly increase player participation in bingo games.

Electronic bingo systems may conduct bingo games relatively quickly in comparison to traditional paper bingo games, and allow the players to receive results very quickly. The speed with which bingo game results are returned to the players and other aspects of electronic bingo gaming systems provide a great deal of flexibility in presenting the results to the players. However, there remains a need to increase player participation in electronically implemented bingo gaming systems and to further decrease the time required to play bingo games.

SUMMARY OF THE INVENTION

The present invention provides apparatus and methods for presenting multiple bingo game results on a common display. According to the invention, a bingo game player may participate in a number of bingo games and obtain a respective bingo game result for each of those games. Instead of displaying each different bingo game result on a separate display, the present invention includes producing a common graphic display that presents two or more bingo game results simultaneously. As used in this disclosure and the accompanying claims, the designation "common graphic display" refers to a graphic presentation that shows two or more bingo game results in a single graphic representation such as, for example, a representation of a number of reels for a reel-type game (slot machine).

One preferred method according to the present invention includes identifying a respective bingo game result for each of a number of respective bingo game play requests. These respective bingo game results combine to amount to a cumulative result for the number of bingo game play requests. The method also includes producing a common graphic display representative of the cumulative result for the number of bingo game plays. This method gives players the opportunity to participate in multiple bingo games simultaneously and receive the results in a single presentation. Consequently, players are able to participate in more bingo games in a given period of time. In addition, this method enhances a player's bingo gaming experience by decreasing the time needed to display multiple bingo game results, since players only have to view the common graphic display and need not wait for a sequence of individual bingo game result presentations.

An apparatus according to the present invention preferably includes a bingo game processor for identifying a respective bingo game result for each of the bingo game plays made by a player. A result display engine receives these individual bingo game results and defines a common graphic display that represents or shows all of those results on a common graphic display at a suitable display device. Some preferred forms of the present invention may also include a display controller and perhaps other processing elements at the location of the display device to direct the display device to produce the graphic images required by the common graphic display defined by the result display engine.

These and other advantages and features of the invention will be apparent from the following description of the preferred embodiments, considered along with the accompanying drawings.

DESCRIPTION OF PREFERRED EMBODIMENTS

The present invention may be used to provide a common graphic display for multiple bingo game results in many different types of bingo gaming systems. The following description of the present invention will be made in reference to a particular bingo gaming system disclosed fully in U.S. patent application Ser. No. 10/456,721 entitled "Method, System, and Program Product for Conducting Multiple Concurrent Bingo-Type Games," which has been incorporated in this application by reference above. This patent application is published in U.S. patent application publication No. 2004/0152499 A1. However, it should be noted that the invention is not limited to this particular bingo gaming system. Rather, the invention may be used in connection with any bingo gaming system utilizing an electronic player station to present results to a bingo game participant.

Figure 1:
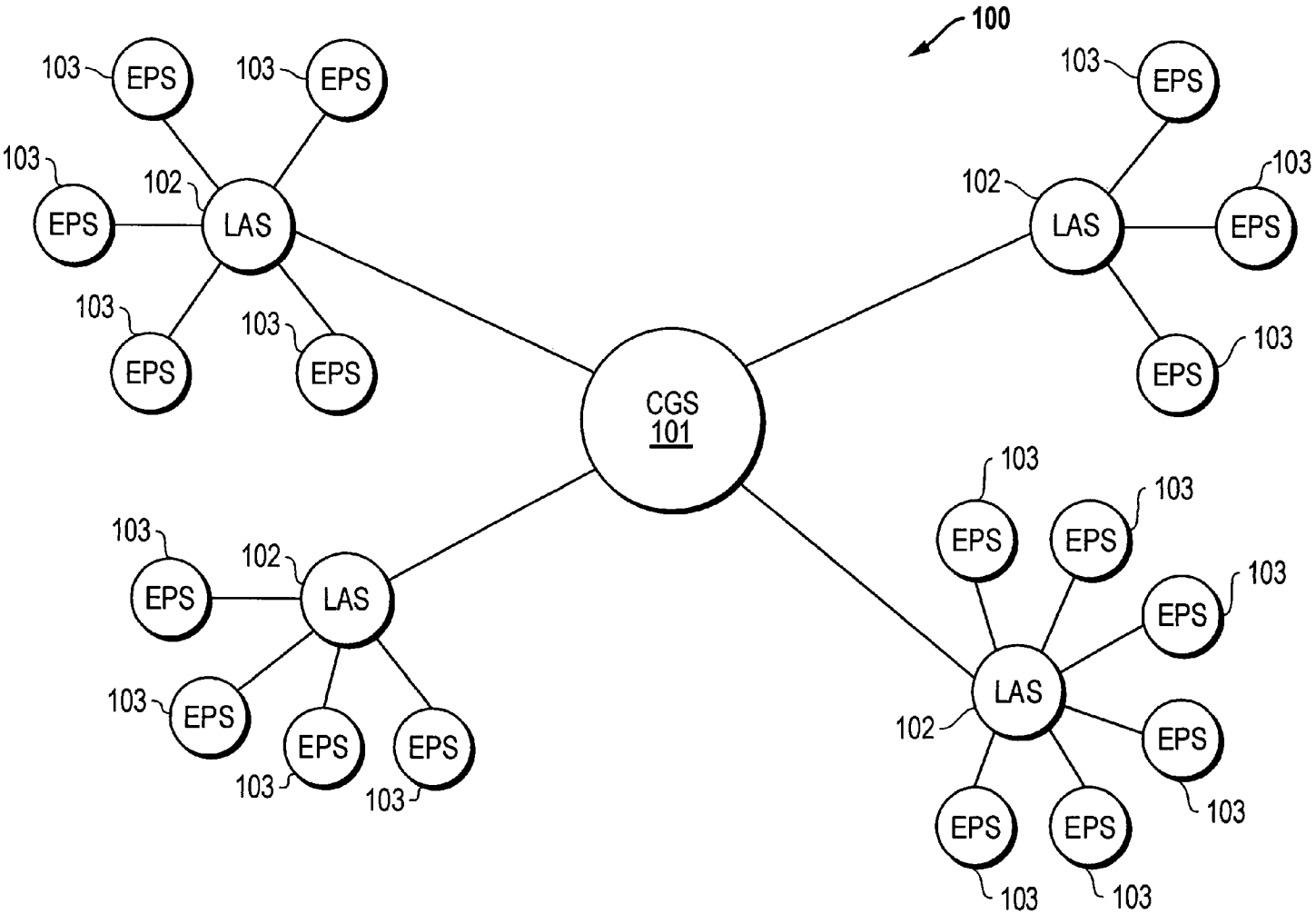
FIG. 1 is a high level diagrammatic representation of a bingo gaming system embodying the principles of the present invention.

The gaming system 100 shown in FIG. 1 includes a central game server (CGS) 101 that cooperates with a number of other components to enable bingo players, preferably at many different remote gaming sites, to participate in bingo games. Each gaming site includes a local area server (LAS) 102 and a number of electronic player stations (EPSs) 103. As will be discussed in detail below, in the normal operation of gaming system 100, a player at any EPS 103 in the system may participate in a given bingo game with players at any other EPSs 103 in the system. Thus, players at different gaming facilities may be grouped together for a given bingo game administered through system 100. Grouping together players from different gaming facilities for the play of a bingo game allows different bingo games to be played rapidly and minimizes the time that players must wait to receive their bingo game results.

The invention includes an arrangement for grouping players and/or game play requests for the play of a single bingo game to facilitate rapid play. This grouping includes limiting the number of players and/or game play requests included in a bingo game to reduce the time required to play the game. System 100 reduces the time between a game play request at one of the EPSs 103 and the return of bingo game results to the respective EPS sufficiently to allow a great deal of flexibility in how results in the bingo game are displayed to the player. In particular, the bingo game results may be displayed in some manner unrelated to bingo. For example, the bingo game results may be mapped to a display traditionally associated with a reel-type game (slot machine), to a display relating to a card game, or to a display showing a race such as a horse or dog race, for example. Preferred techniques for mapping bingo game results to displays associated with games or contests unrelated to bingo are described in U.S. Patent Application Publication No. 2002/0132661 A1 entitled "Method, Apparatus, and Program Product for Presenting Results in a Bingo-Type Game." The entire content of this publication is incorporated in this application by this reference.

System 100 rapidly groups players and/or game play requests and starts one game after another so that multiple games may be in play at any given time. That is, once a first group of players or game play requests has been assigned to a bingo game offered through system 100, the system proceeds to simultaneously administer a bingo game for the first group of players or game play requests and also begin grouping players or game play requests for a next bingo game. System 100 does not necessarily wait for one bingo game to be completed before starting to collect players or game play requests for, and actually beginning play in, the next bingo game. The number of players or game play requests grouped for the play of bingo games according to the present invention may be limited to reduce the time required for grouping. For example, each bingo game offered through gaming system 100 shown in FIG. 1 may be limited to between 2 to 20 players or game play requests, with the preferred number for any given game being from 10 to 15. Where system 100 includes numerous EPSs 103 at the various remote locations, on the order of several thousand EPSs for example, hundreds of individual bingo games may be in progress at any given time through the gaming system. Furthermore, results for a number of different bingo games may become available in a very short time frame. The time frame in which multiple bingo game results may become available for a given player may be so short that the results appear to become available simultaneously.

Regardless of the rapid play facilitated by system 100 and regardless of the manner in which the bingo game results are displayed, the underlying game remains a standard bingo game played in the traditional sequence of play for bingo games. That is, each player obtains or is assigned a bingo card or bingo card representation, all bingo cards in play in the game are daubed or checked for matches with a randomly generated sequence of designations (for example, designations produced in a ball draw or produced by a random number generator), and the first card in the game to match the sequence of designations to produce the game ending pattern wins the bingo game. Additional prizes may be awarded for other patterns that may be produced in the course of the bingo game. The mapping of different prizes to various bingo patterns that may be produced in the course of a bingo game in system 100 may be accomplished as described in U.S. Pat. No. 6,569,017 B2, entitled "Method for Assigning Prizes in Bingo-Type Games" or U.S. Patent Application Publication No. 2004/0048647 A1, entitled "Prize Assignment Method and Program Product for Bingo-Type Games." The entire content of each of these documents is incorporated herein by this reference.

Figure 2:
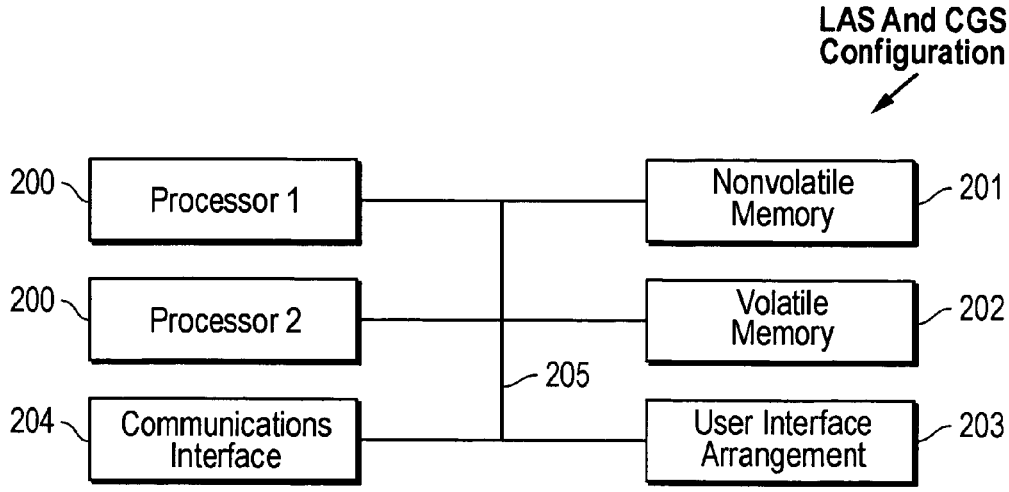
FIG. 2 is a diagrammatic representation of a computer system arrangement that may be used for the central game server and local area servers included in the system shown in FIG. 1.

CGS 101 may comprise a computer system such as the basic system shown in FIG. 2. The basic system may include one or more processors 200, nonvolatile memory 201, volatile memory 202, a user interface arrangement 203, and a communications interface 204, all connected to a system bus 205. It will be appreciated that user interface arrangement 203 may include a number of different devices such as a keyboard, a display, and a pointing device such as a mouse or trackball for example, although not shown in FIG. 2. Alternatively to the integrated user interface arrangement 203 shown in FIG. 2, a user interface for CGS 101 may be provided through a separate computer (not shown) in communication with the CGS. Regardless of the particular configuration for CGS 101, in the normal operation of system 100 shown in FIG. 1, the CGS functions to group players for participation in bingo games offered through the system, produces or obtains sequences of designations (ball draws, for example) for the play of the bingo games, identifies the bingo game results, and communicates the results to LASs 102.

As used in this disclosure, any sequence of designations that may be matched against bingo cards or bingo card representations in the present gaming system will be referred to as a "ball draw" regardless of how the sequence is actually generated. Under this definition, it will be appreciated that a ball draw may be produced by a random number generator, a pseudo random number generator, or any other suitable device or system, and not necessarily a physical ball draw device.

Each LAS 102 included in system 100 as shown in FIG. 1 may comprise a computer system having the same basic structure as shown in FIG. 2. That is, each LAS 102 may include one or more processors 200, nonvolatile memory 201, volatile memory 202, user interface arrangement 203, and communications interface 204 all connected to system bus 205. As with CGS 101, the user interface for the respective LAS 102 may be provided through a separate computer in communication with the LAS rather than the integrated user interface arrangement 203 shown in FIG. 2. Regardless of the specific configuration of the LAS, each LAS serves, in normal operation of the system shown in FIG. 1, to transfer or relay information from its respective EPSs 103 to CGS 101 and transfer or relay information from the CGS to the LAS's respective EPSs. Each LAS according to the present invention may also have the ability to group players and actually play bingo games in certain situations. For example, where one LAS 102 serves a large number of EPSs 103, the LAS may group players or game play requests from its respective EPSs during a time of high player activity, obtain or produce a ball draw, identify bingo game results, and return results to the EPSs rather than having the CGS 101 perform these tasks. Also, each LAS 102 shown in FIG. 1 may be configured to perform the tasks normally performed by CGS 101 in the event the communications link between the respective LAS and CGS is degraded below a certain level or is severed altogether.

Figure 3:
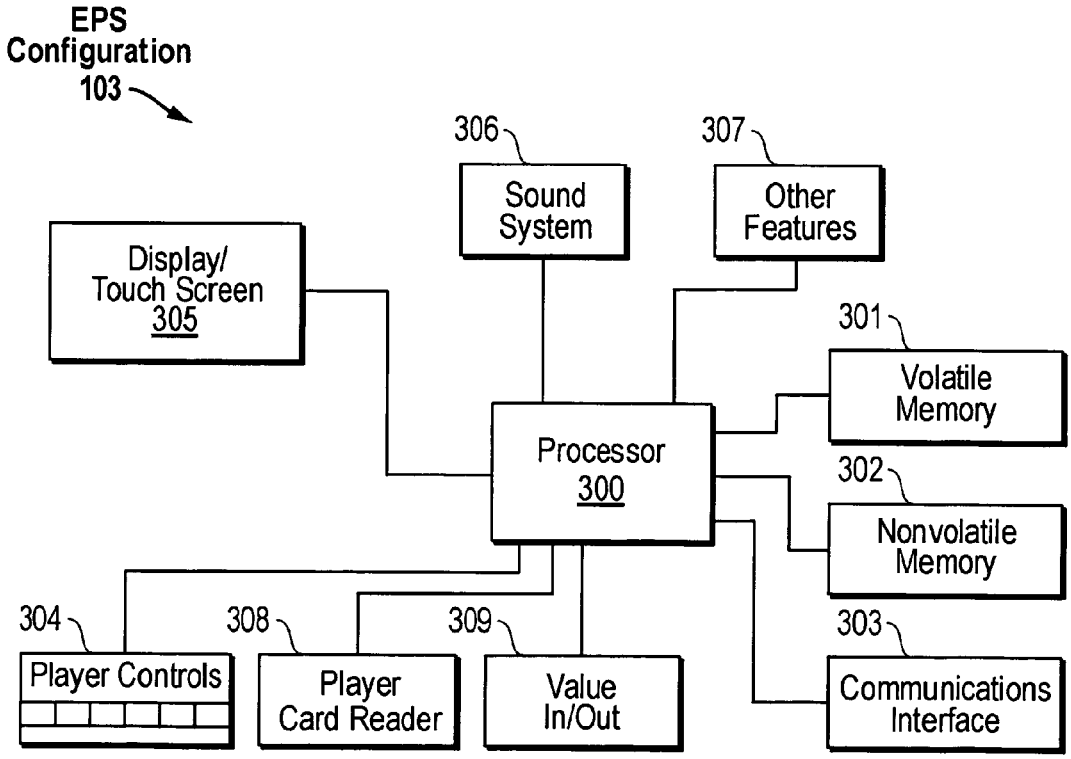
FIG. 3 is a diagrammatic representation of an electronic player station that may be used in the system shown in FIG. 1.

FIG. 3 shows an example of an EPS 103 that may be used in a gaming system embodying the principles of the present invention. The illustrated EPS 103 includes a processor 300, volatile memory 301, nonvolatile memory 302, and a communications interface 303. The volatile and nonvolatile memory stores computer program code that may be executed by processor 300 to cause the processor to perform or direct the various functions provided by EPS 103. Communications interface 303 allows communications between EPS 103 and its respective LAS 102 and/or CGS 101. EPS 103 also includes a special user interface arrangement to facilitate player participation in the bingo games offered through gaming system 100 shown in FIG. 1, and display results in an exciting and attractive format. This interface includes player controls 304, a display device or touch screen display 305, a sound system 306, and perhaps other features 307 such as alarms or special displays or alerting devices. Each EPS 103 also preferably includes a convenient system for allowing the player to input player-specific information and for receiving wagers and dispensing winnings. For example, the EPS 103 shown in FIG. 3 includes a player card reader 308 that is adapted to read player-specific information from a player account card inserted into the reader. A player account card may, for example, include player information or simply a player identifier encoded on a magnetic medium (mag stripe) associated with the card, or encoded on a bar code, or a memory device associated with the player account card. The illustrated EPS 103 also includes a device 309 for receiving value and issuing value in the course of play. This device may accept currency, vouchers, or tokens, for example, and also output currency, vouchers, or tokens. Of course, a separate device may be used to receive and issue value for games played according to the present invention. Alternatively, or in addition to value in/out device 309, EPSs 103 may read player account information from the player account card or from player information otherwise input at the EPS, and may account for wagers and winnings in the manner set out in U.S. Patent Application Publication No. 2002/0132666 A1, entitled "Distributed Account Based Gaming System."

It will be appreciated that the particular configuration of devices shown in FIG. 1 is shown only for purposes of example. A bingo gaming system according to the present invention may omit some or all of the separate LASs 102 at the various gaming facilities so that the EPSs 103 communicate directly with CGS 101. Also, various regions or different gaming facilities may be divided up into separate systems each having a respective CGS such as CGS 101. In these situations the system could be configured such that a single EPS 103 may be serviced by any of the CGSs. Furthermore, a gaming system embodying the principles of the invention may include multiple CGSs rather that a single CGS 101 as shown in FIG. 1.

Figure 4:
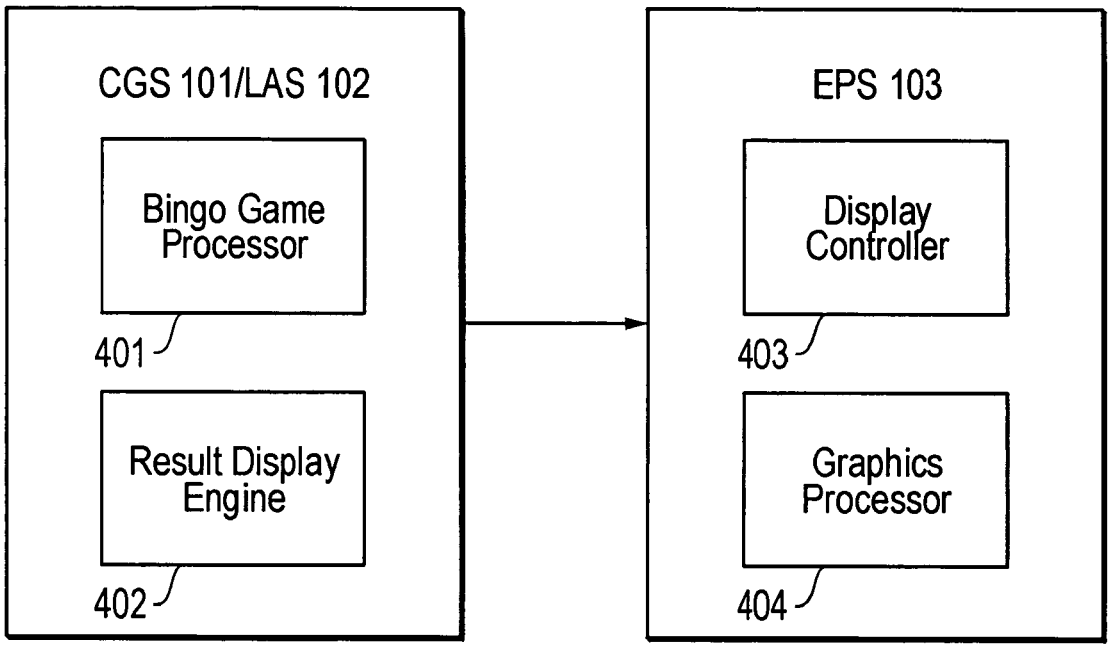
FIG. 4 is a diagrammatic representation of an embodiment of the present invention as implemented with the system shown in FIG. 1.

FIG. 4 may be used to describe the components of one embodiment of the present invention as implemented in connection with gaming system 100. The illustrated gaming system includes bingo game processor 401, result display engine 402, display controller 403, and graphics processor 404. Bingo game processor 401 produces, obtains, or identifies a bingo game result for each of a number of game play requests in each bingo game conducted through the system. Result display engine 402 defines a common graphic display that represents or shows a number of bingo game results. Each common graphic display defined by result display engine 402 may be used to present multiple results to a given player simultaneously. The apparatus shown in FIG. 4 uses display controller 403 in conjunction with graphics processor 404 to cause a display device (such as display 305 in FIG. 3) associated with an EPS 103 to present graphics for the respective common graphic display.

The functions performed by bingo game processor 401 preferably take place at either a respective CGS 101 or a respective LAS 102 in the system 100 shown in FIG. 1. Bingo game processor 401 may be implemented through one of processors 200 in FIG. 2 or could be implemented as a separate processing device included in or associated with the respective CGS 101 or LAS 102. In a preferred embodiment, bingo game processor 401 identifies bingo game results for a number of respective bingo game plays in a manner similar to that described more fully in U.S. Patent Application Publication No. 2004/0152499 A1, which is referenced above. However, bingo game processor 401 is not limited to identifying bingo game results according to any particular method. Rather, any suitable method can be used to identify the bingo game results according to the present invention.

In the embodiment of the invention shown in FIG. 4, bingo game processor 401 sends bingo game results for a related group of game play requests for a particular player to result display engine 402 which then defines a particular common graphic display. According to this embodiment of the invention, result display engine 402 may define a common graphic display by selecting a respective result representation for each bingo game result and including each respective result representation in the common graphic display. Alternatively, result display engine 402 may define the common graphic display by selecting a graphic display that is consistent with a cumulative result for the related group of game play requests, and without regard to any of the individual bingo game results. It will be noted that in either of these alternatives the common graphic display defined according to the invention is representative of the cumulative result that is obtained by combining the individual bingo game results into a cumulative result value. Examples showing the relationship between the individual bingo game results, cumulative result, and common graphic display will be described below with reference to FIG. 6.

Result display engine 402 is preferably implemented through the same processing device or system of processing devices that implements bingo game processor 401, either CGS 101 or a respective LAS 102. However, it is possible that each respective EPS 103 having multiple game result display capabilities according to the invention may separately implement its own result display engine. The processes necessary to implement the functions of result display engine 402 are described in more detail with respect to FIGS. 5 and 6.

In a preferred form of the invention, each EPS 103 having multiple game result display capability includes a respective display controller 403 and graphics processor 404. Thus, FIG. 4 shows display controller 403 and graphics processor 404 included with an EPS 103. For example, display controller 403 may be implemented through the EPS processor 300 shown in FIG. 3 and the graphics processor 404 may be implemented through a separate processing device operatively connected between processor 300 and display 305. Although display controller 403 and graphics processor 404 are shown implemented through hardware included with an EPS 103 in FIG. 4, those skilled in the art will appreciate that the functions of the display controller and graphics processor may be performed using any number of hardware arrangements. For example, all of the processing required to produce the signals used to generate the actual images on the display device at an EPS 103 may be performed at some location remote to the particular EPS 103, such as CGS 101 or LAS 102, and communicated to the EPS 103 through a cable or some other signal communication arrangement.

A method according to the invention may be described with reference to the diagram of FIG. 5. In the following description of FIG. 5 it will be appreciated that the references to the physical components are references to the diagrams in FIGS. 1 through 4 that show those components.

The illustrated process begins with submitting multiple game play requests from a single player station such as an EPS 103 shown in FIG. 1. This step of submitting game play requests is shown at process block 501 in FIG. 5. It should be noted that some EPSs 103 according to the invention may require players to submit multiple game play requests while other EPSs may allow multiple game play requests to be submitted as an option. Each game play request submitted from an EPS 103 will be associated with a bingo card representation. Previously referenced Patent Application Publication No. 2004/0152499 A1 describes several steps that may occur or be required in the course of submitting a game play request in a bingo system. For example, a player may be required to select a bingo card representation and select a wager amount for each game play request. Alternatively, bingo card selection may be automated so that the player need only select the number of game plays the player desires, and a wager amount may be dictated by the system, selected once by a player for multiple game play requests, or individually selected for each game play request. The details involved in the game play request submission steps will not be repeated here in order to prevent obscuring the present invention in unnecessary detail. It should be appreciated that the present invention encompasses any process or procedure at a player station in which a player makes multiple game play requests either simultaneously or incrementally over a period of time. However, it will be appreciated that preferred forms of the invention allow a player to ultimately enter a single input in order to actually submit multiple game play requests simultaneously. For example, a player may make a number of inputs to select the number of game play requests to be submitted and the wagers associated with the game play requests, and then actuate a "play" button to actually submit multiple game play requests simultaneously. Alternatively, different related game play requests may be submitted over a period of time by multiple player inputs. Regardless of how multiple game play requests are submitted, each game play request will, at some point in the system, be associated with a particular bingo card representation and this bingo card representation is used in identifying a result for the respective bingo game play request.

Figure 5:
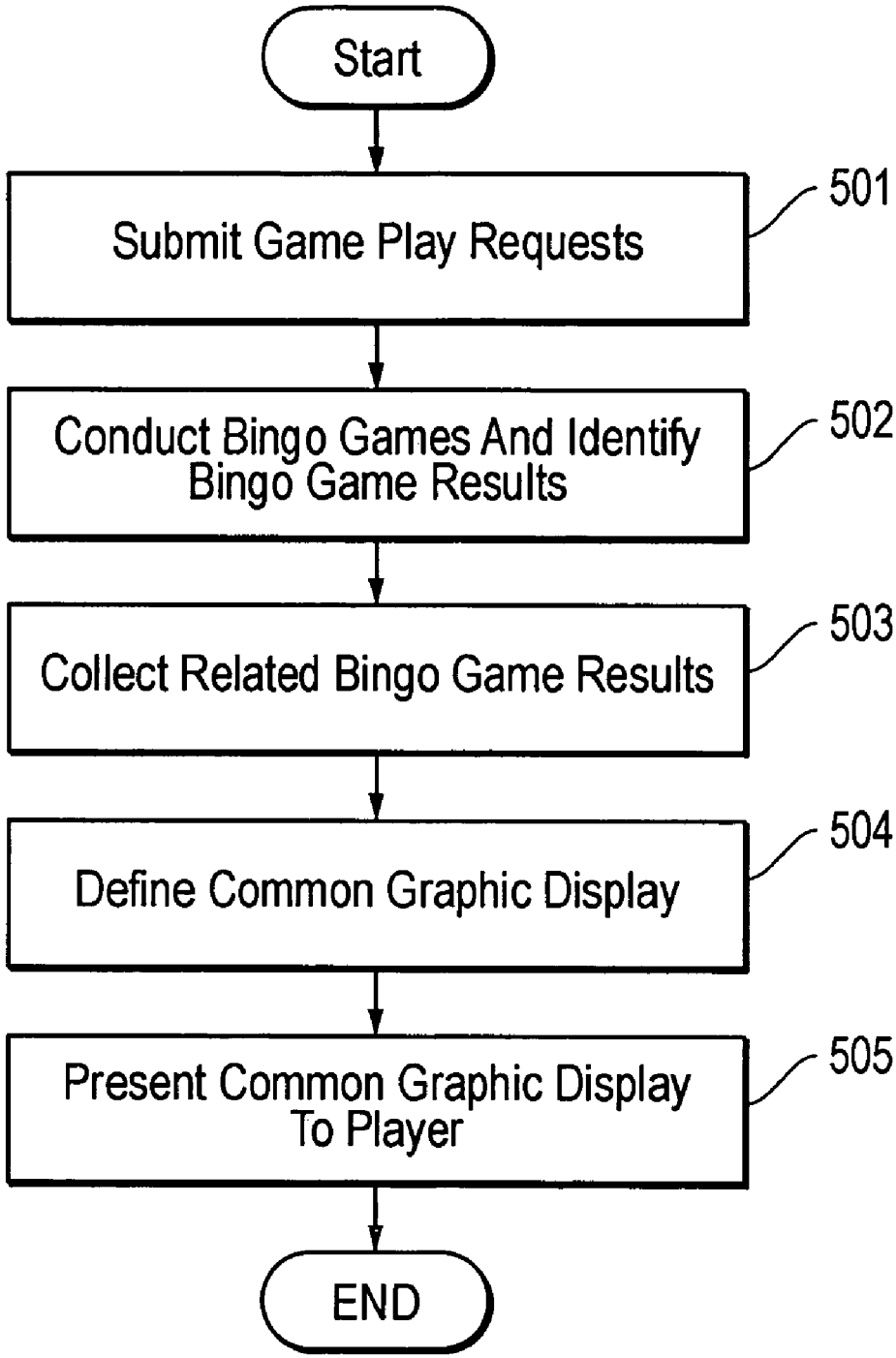
FIG. 5 is a flow chart illustrating a process embodying the principles of the present invention.

As shown at process block 502 in FIG. 5, a method according to the present invention also includes conducting one or more bingo games and identifying the corresponding bingo game results for each game play request that was submitted by a player at process block 501. The bingo games may be conducted at a suitable bingo game processor such as CGS 101 or LAS 102 in a manner set out in the previously referenced U.S. Patent Application Publication No. 2004/0152499 A1, which includes a discussion on producing a ball draw, grouping together the game play requests submitted from a number of player stations to form a quorum for playing a respective bingo game, and comparing bingo card representations to the ball draw to identify game winning patterns. Details of these processes included in conducting bingo games and identifying bingo game results will not be repeated here because the present invention encompasses any arrangement of processes or steps for conducting bingo games and identifying results. However, it should be noted that the manner in which game play requests are grouped to conduct bingo games may be affected by a player's ability to submit multiple game play requests as indicated at process block 501. In particular, it may be desirable to ensure that each game play request submitted by a single player according to the present invention is included in a different bingo game conducted by the bingo game processor. In this preferred form of the invention the bingo game processor or other suitable element performs the added function of separating game play requests submitted by a single player at process block 501 and groups the different game play requests into different game groups.

Other forms of the invention may divide related game play requests from a given player up so that the game play requests are included in at least two different game groups or so that the game play requests from a given player do not form more than a given percentage of the overall number of game play requests in a game group. Yet other forms of the invention may divide related game play requests up so that each game group includes game play requests from at least two different players. It is possible to implement the present invention so that a player submitting, for example, eight game play requests may have all of those game play requests grouped into a single bingo game group and may have a bingo game conducted between those requests. In this example, the player is essentially playing a single bingo game against himself and thus systems that allow this type of grouping preferably require that each game play request be associated with a different bingo card representation. It is further noted that where a player's own game play requests are always grouped into a game group without including any game play requests from other players, the game may be implemented in a stand-alone player station.

In order to actually make identified results available to a player, a bingo gaming system according to the present invention may require some action by the player at their player station other than simply entering the game play requests. For example, a player may need to enter a daub input each time a bingo game result is identified for a particular bingo card/game play request. Alternatively, the player may only need to submit one daub input after all of the bingo game results have been identified or an automatic daubing procedure may be implemented. Other forms of the invention may require a player to enter a daub input and a prize claiming input for each group of related game play requests from the player or a daub input and a prize claiming input for each game play request in a group of related game play requests.

Process block 503 next shows collecting bingo game results for the multiple related game play requests submitted at process block 501 for or by a given player. In order to collect the related bingo game results, bingo game processor 401 (FIG. 4) is preferably able to distinguish bingo game results associated with related game play requests from bingo game results that are associated with other game play requests not included in the group submitted at process block 501. One way of implementing this preferred form of the invention relates to the information included in the game play requests submitted for a particular group at process block 501. Each game play request in a group submitted by a single player at process block 501 may be associated with a unique identifier. This identifier is also associated with the respective result identified for the respective game play request and the results may be collected according to the identifier. In some preferred forms of the invention the identifier may include a count of the number of related game play requests submitted at process block 501. This information may be used by the bingo game processor or other component in the system collecting related bingo game results to identify when all of the results for a given group of related game play requests have been collected.

In the preferred form of the invention shown in FIG. 5, once all of the related bingo game results have been collected, the system defines a common graphic display as indicated at process block 504. The common graphic display may be defined using a number of different methods performed at result display engine 402 shown in FIG. 4. In one preferred form of the invention, the common graphic display comprises a representation of a multiple line reel-type machine (slot machine). Each pay line in the display may be used to show a result for a particular one of the game play requests submitted by a player at block 501 in FIG. 5. Where each pay line in such a display is dedicated to showing a result for a given one of the game play requests, the number of game play requests that may be submitted at process block 501 is limited by the number of pay lines in the display. However, some forms of the present invention do not require a one-to-one correspondence between the game play requests submitted at block 501 and pay lines in the combined display. In these forms of the invention, result display engine 402 shown in FIG. 4 may select graphics to show winning combinations of symbols on a number of pay lines that is less than the number of game play requests submitted at block 501. The cumulative result indicated by the pay line graphics will equal the total of the individual related bingo game results collected at block 503. The common graphic display defined at block 504 in FIG. 5 will be described further below with reference to specific examples shown in FIG. 6. In yet other forms of the invention there may be no correspondence between any individual result for a given game play request and a pay line in a common graphic display. In these forms of the invention, result display engine 402 simply selects any combination of pay line graphics required to produce a common graphic display to represent the cumulative result for a set of related game play results.

Defining a common graphic display according to the present invention involves processing to identify a common graphic display that meets the given display requirements. For example, in a preferred form of the invention, each potential combination of individual bingo game results is associated in a database with one or more common graphic displays and this data is stored so that it is accessible to the result display engine 402 in FIG. 4. Once the related bingo game results are collected, the result display engine simply looks up the common graphic display or set of displays that may be used to show those collected results and chooses one of the predefined common graphic displays. This technique of using a database of predefined common graphic displays, each associated with a given combination of potential bingo game results may be used to define a common graphic display for a set of bingo game results regardless of the constraints for showing the various related results. However, at least one common graphic display must be available for each potential combination of results and display constraints.

Process block 505 shows that the final step in a preferred method according to the invention is presenting the common graphic display to the player who submitted the multiple game play requests at block 501. This common graphic display presented at block 505 is the common graphic display defined at block 504, and is presented to the respective player using a suitable display device at the player's player station (such as display device 305 at EPS 103 shown in FIG. 3). In a preferred form of the invention, the common graphic display is produced on a display device under the control or direction of display controller 403 and graphics processor 404 shown in FIG. 4. Display controller 403 sends suitable graphics instructions and data to graphics processor 404 which in turn processes the instructions and provides suitable display driving signals to the display device. The display device (display device 305 in FIG. 3, for example) then produces the desired common graphic display.

In preferred forms of the present invention the common graphic display is defined by result display engine 402 using a representative code rather than an actual graphics definition that could be processed by a suitable graphics processor to drive a display device. In one form of the present invention, for example, a graphic symbol or component of a common graphic display, or even an entire common graphic display, will be represented by a code. The code or codes for the common graphic display forms a definition for the display which may be communicated to display controller 403. Display controller 403 may then accesses a local data storage device to locate the actual graphics data and instructions associated with each code and directs graphics processor 404 to process the data and produce the signals required to drive the player's display device. This preferred arrangement of communicating the common graphic display definition from result display engine 402 to the player station in the form of one or more display definition codes minimizes the amount of data that must be transferred to the player station to cause the desired graphic to be displayed, and this minimization of data is beneficial particularly where the result display engine and player station are separated over a network. However, it will be appreciated that it is possible for the result display engine 402 to actually generate the stream of data necessary for directing a display device to produce the desired common graphic display. In forms of the invention that use the result display engine 402 to generate the graphics instructions and data, display controller 403 may be omitted. Even graphics processor 404 may be omitted at a player station if the result display engine is capable of generating the actual display driving signal.

Figure 6:
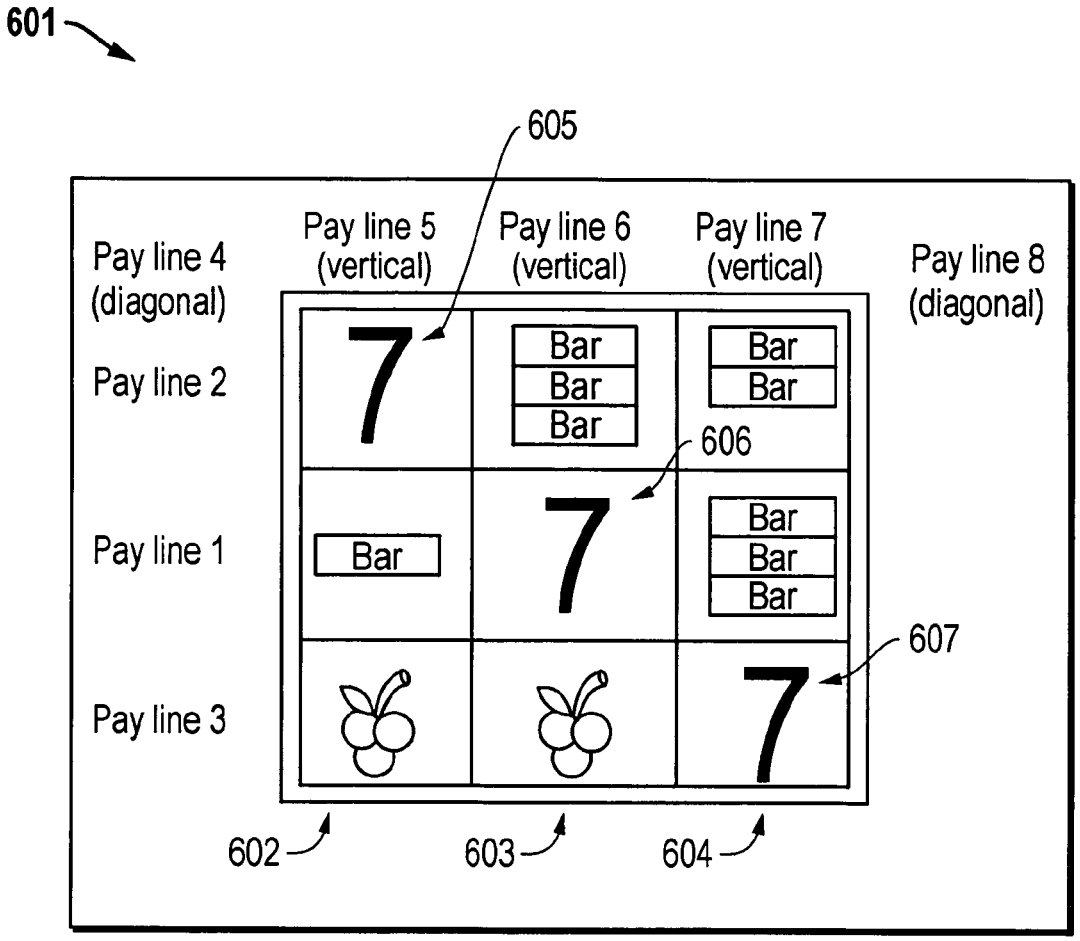
FIG. 6 is a representation of a common graphic display that may be used to communicate a cumulative result to a player according to the present invention.

FIG. 6 provides an example of a graphical representation that may be used to display multiple bingo game results to a player according to one embodiment of the present invention. The common graphic display 601 shown in FIG. 6 comprises a reel-type or slot machine-type display having a two-dimensional matrix of graphic symbol locations. Each graphic symbol location is occupied by a graphic symbol, which in this example includes a "7," a bar symbol (single, double, and triple bar), or a "cherries" symbol. In common graphic display 601, a series of three reel representations 602, 603, and 604 correspond to the reels of a reel-type game (slot machine-type game) and are represented as having various graphic symbols at three adjacent reel locations aligned vertically. This results in a three-by-three matrix of graphic symbol locations that may be used to define eight different linear, three-symbol pay lines. These pay lines are shown as pay lines 1 through 8 in FIG. 6. This common graphic display may be generated at a player station such as an EPS 103 shown in FIG. 1 where a player may enter a number of related game play requests. As in all reel-type games, a pay table correlates a prize with a set of symbols that may appear along a pay line. For example, a pay table may define the set of symbols at pay line 4, that is, three "7s" in a row as winning or paying 50 credits. The symbols "cherries," "cherries," "any symbol" as aligned along pay line 3 may be defined as winning or paying 5 credits, for example. The rest of the symbol sets along the other pay lines in FIG. 6 may be associated with no prize.

It should be borne in mind that common graphic display 601 shown in FIG. 6 is defined in the preferred form of the invention by a suitable processing device such as result display engine 402 shown in FIG. 4 in the process described with reference to process block 504 in FIG. 5. Thus, although the example common graphic display shown at FIG. 6 appears to be a slot machine-type display, the displayed graphic symbols are dictated ultimately by the bingo game results for a number of different bingo game play requests submitted by a player.

In one embodiment of the present invention, the bingo game result associated with each game play request in a set of related requests entered by a player as shown at block 501 in FIG. 5 may be shown as a result representation at one of the pay lines shown in the example of FIG. 6. This embodiment limits the number of bingo game results that may be displayed at common graphic display 601 to eight different results. Using the example reel stop positions shown in FIG. 6, the bingo game result displayed for a first game play request corresponds to the result representation at pay line 1, "single bar, 7, triple bar." The bingo game result for a second game play request submitted by the player in the bingo gaming system is shown by the representation at pay line 2, with the symbols "7, triple bar, double bar." Pay line 3 shows the result representation "cherries, cherries, 7;" pay line 4 shows the result representation "7, 7, 7;" pay line 5 shows the result representation "7, single bar, cherries;" pay line 6 shows the result representation "triple-bar, 7, cherries;" pay line 7 shows the result representation "double-bar, triple-barr, 7;" and finally, pay line 8 shows the result representation "double-bar, 7, cherries."

It will be appreciated from the common graphic display 601 in FIG. 6 that the result representation shown at a given pay line may affect the result representation shown at another pay line. The result representations at the various pay lines must be consistent in order to properly reflect the bingo game results associated with a number of game play requests making up a related group of game play requests as submitted at block 501 in FIG. 5. The different types of result representations for showing each different bingo game result are selected so that for any possible mix of bingo game results, at least one solution exists to show all of the corresponding result representations on the common graphic display. For example in the illustration shown in FIG. 6, if the player has made eight game play requests with the bingo game result of the different game play requests represented at pay lines 1 through 8, the result representation at pay line 1 affects the result representations corresponding to each of the other pay lines. That is, the result representation shown at pay line 1 is made up of reel-type graphic symbols that are also necessarily included in each of the other pay lines 2 through 8. In the illustrated example of reel stop positions, the reel symbol "single bar" at position 605 comprises the first graphic symbol in the result representation at pay line 1 and the second graphic symbol in the result representation at pay line 2. Similarly, the reel symbol "7" shown at position 606 comprises the second graphic symbol in pay lines 1, 4, 6, and 8, and the reel symbol "triple bar" shown at position 607 comprises the last graphic symbol in pay line 3 and the last graphic symbol in pay line 7.

In order to ensure that the result representations at the various pay lines in display 601 are consistent in forms of the invention in which each line must show a respective bingo game result, the present invention may define a number of equivalent result representations to display the same bingo game result for a respective game play request. For example, a straight line bingo may be represented by the symbol sequence "cherries, cherries, any symbol" where the "any symbol" may be any of the available graphic symbols in the game presentation. Thus, the bingo game result associated with pay line 3 in FIG. 6 achieved a straight line bingo during a particular bingo game, and the common graphic display shows "cherries, cherries, 7" along pay line 3 in order to be consistent with the result which is shown along pay line 4, the symbol sequence "7, 7, 7" in this example.

In order to provide more flexibility in defining common graphic displays such as 601 where the result represented along one pay line affects one or more other pay lines, each pay line may be used to represent the result associated with an undefined one of the game play requests. In this form of the invention the result for a first bingo game play request may be shown at any of the pay lines.

In another embodiment of the present invention, the common graphic display may not be constrained to show any of the individual bingo game results, but only show a graphic that is consistent with the cumulative result for the different results for a related group of game play requests submitted at block 501 in FIG. 5. In these forms of the present invention, the element in the system that defines the common graphic display need only receive a cumulative result or representation of a cumulative result for a related group of game play requests. The element responsible for defining the common graphic display, such as result display engine 402 in FIG. 4, may have access to a database that correlates each potential cumulative result that may be achieved with some group of related game play requests with one or more, and preferably many different common graphic displays that provide a graphic representation (a cumulative result representation) of the respective cumulative result. The common graphic display may then be defined by querying the database with the given cumulative result to identify one or more common graphic displays that show that cumulative result and selecting one of those common graphic displays. As discussed above, the common graphic display is preferably represented by a code or series of codes which is communicated from the display defining element such as result display engine 402 to the system components responsible for producing the actual graphic display at the respective player station (display controller 403, graphics processor 404, and the player station display device in the above described example).

An example of an embodiment of the invention using only a cumulative result may be described using the example result display 601 shown in FIG. 6. For purposes of this example, again assume that the relevant pay table defines the symbol sequence "7, 7, 7" as winning 50 credits and the symbol sequence "cherries, cherries, any symbol" as winning 5 credits, and that none of the other symbol combinations correlate to any credit win level. Thus, the common graphic representation 601 correlates to a cumulative result of 55 credits. Now for purposes of this example, assume that a straight line bingo result entitles the player achieving that pattern to 5 credits, a "T" pattern entitles a player achieving that pattern to 20 credits, and an "H" pattern entitles a player achieving that pattern to 30 credits. Further assume that a player enters six game play requests in a gaming system according to the invention as described above with reference to block 501 in FIG. 5, and achieves a straight line bingo for one game play request, a "T" pattern for one game play request, a "H" pattern for another game play request, and no other winning patterns for the remaining three game play requests the player entered. Once these results are collected as indicated at block 503 in FIG. 5, it will be known that the cumulative result for the six related game play requests correlates to 55 credits. The results or the cumulative result may then be communicated to the component in the present system responsible for defining the common graphic display such as result display engine 402 in FIG. 4. This element may then select a common graphic display that correlates to that 55 credit value such as the display 601 shown in FIG. 6. As mentioned above, each potential cumulative result is preferably correlated to a number of equivalent common graphic displays so that the same graphic display is not used every time a given cumulative result is achieved. The equivalent common graphic displays may be selected at random or in any suitable manner.

In the example set out in the previous paragraph; the number of actual bingo game results is higher than the winning pay lines (winning result representations) shown in the common graphic display. The invention is by no means limited to this situation. Rather, the number of winning bingo game results could be lower than the number of winning pay lines shown on the common graphic display, or the number of winning bingo game results could be the same as the number of winning pay lines shown in the common graphic display. It will further be noted that where there need not be a one-to-one correspondence between game play requests/bingo game results and pay lines/result representations, a player may enter more game play requests as indicated at block 501 in FIG. 5 than there are result representations in the common graphic display. That is, even though the example common graphic display 601 in FIG. 6 shows eight pay lines, the common graphic display could be used to show a cumulative result for nine or more game play requests.

The above described preferred embodiments are intended to illustrate the principles of the invention, but not to limit the scope of the invention. Various other embodiments and modifications to these preferred embodiments may be made by those skilled in the art without departing from the scope of the invention.

The invention claimed is:

1. A method including:

(a) identifying with a game processor a respective bingo game result for each of a number of respective bingo game play requests, the respective bingo game results combining to amount to a cumulative result for the number of bingo game play requests; and (b) producing a common graphic display representative of the cumulative result for the number of bingo game play requests, wherein the common graphic display comprises a two-dimensional matrix of graphic symbol locations having multiple rows and multiple columns, and defining multiple lines of graphic symbol locations, and wherein a result representation for a respective first one of the bingo game results is represented in the two-dimensional matrix as a selected first line of graphic symbol locations, the two-dimensional matrix not comprising a bingo card representation of a bingo card associated with any of the respective bingo game play requests, and a result representation for a respective second one of the bingo game results is represented in the two-dimensional matrix as a selected second line of graphic symbol locations.

2. The method of claim 1 further including selecting a respective result representation for each respective bingo game result, and wherein the common graphic display includes each respective result representation.

3. The method of claim 2 wherein selecting the respective result representation for at least one respective bingo game result includes selecting from a set of equivalent result representations, each equivalent result representation in the set of equivalent result representations being associated with a single result value.

4. The method of claim 1 wherein two respective result representations are each made up of a series of graphic symbols with each series of graphic symbols including a common graphic symbol, and wherein producing the common graphic display includes arranging the two respective result representations in an overlapped fashion so as to share the common graphic symbol.

5. The method of claim 2 wherein each line of graphic symbol locations provides the respective result representation for a respective one of the bingo game results.

6. The method of claim 1 wherein identifying a respective bingo game result for each of a number of respective bingo game play requests further comprises grouping each game play request submitted by a first player in a different bingo game group.

7. The method of claim 1 wherein identifying a respective bingo game result for each of a number of respective bingo game play requests further comprises dividing related game play requests submitted by a first player so that they are included in at least two different bingo game groups.

8. The method of claim 1 wherein identifying a respective bingo game result for each of a number of respective bingo game play requests further comprises dividing related game play requests up so that each game group includes game play requests from at least two different players.

9. The method of claim 1 wherein producing the common graphic display includes selecting a respective cumulative result representation from a set of cumulative result representations associated with the particular cumulative result.

10. An apparatus including:

(a) a bingo game processor for identifying a respective bingo game result for each of a number of bingo game play requests;

(b) a result display engine for defining a common graphic display representative of a cumulative result for the number of bingo game play requests; and (c) a display device for presenting a respective common graphic display corresponding to the cumulative result for the number of bingo game play requests, wherein the common graphic display comprises a two-dimensional matrix of graphic symbol locations having multiple rows and multiple columns and defining multiple lines of graphic symbol locations, and wherein a result representation for a respective first one of the bingo game results is represented in the two-dimensional matrix as a selected first line of graphic symbol locations, the two-dimensional matrix not comprising a bingo card representation of a bingo card associated with any of the respective bingo game play requests, and a result representation for a respective second one of the bingo game results is represented in the two-dimensional matrix as a selected second line of graphic symbol locations.

11. The apparatus of claim 10 further including a display controller, the display controller for determining the graphic images associated with the respective common graphic display.

12. The apparatus of claim 10 wherein the result display engine defines the common graphic display representative of the cumulative result for the number of bingo game play requests by selecting a respective result representation for each respective bingo game result and wherein the common graphic display includes each respective result representation.

13. The apparatus of claim 12 wherein the result display engine selects the respective result representation for at least one respective bingo game result from a set of equivalent result representations, each equivalent result representation in the set of equivalent result representations being associated with a single result value.

14. The apparatus of claim 10 wherein the result display engine defines the respective common graphic display by selecting two respective result representations that are each made up of a series of graphic symbols with each series of graphic symbols including a common graphic symbol, and wherein the result display engine further defines the common graphic display by arranging the two respective result representations in an overlapped fashion so as to share the common graphic symbol.

15. The apparatus of claim 12 wherein each line of adjacent graphic symbol locations provides the result representation for a respective one of the bingo game results.

16. The apparatus of claim 10, wherein identifying a respective bingo game result for each of a number of respective bingo game play requests further comprises grouping each game play request submitted by a first player in a different bingo game group.

17. The apparatus of claim 10 wherein identifying a respective bingo game result for each of a number of respective bingo game play requests further comprises dividing related game play requests submitted by a first player so that they are included in at least two different bingo game groups.

18. The apparatus of claim 10 wherein identifying a respective bingo game result for each of a number of respective bingo game play requests further comprises dividing related game play requests up so that each game group includes game play requests from at least two different players.

19. The apparatus of claim 10 wherein the result display engine defines the common graphic display representative of the cumulative result for the number of bingo game play requests by selecting a respective cumulative result representation from a set of cumulative result representations associated with the respective cumulative result.

20. The apparatus of claim 10 wherein the result display engine defines the common graphic display representative of the cumulative result for the number of bingo game play requests by assigning a display code for the respective cumulative result.

* * * * *